United States Patent [19]

Davis

[11] 4,076,243

[45] Feb. 28, 1978

[54] TABLE GAME

[76] Inventor: David R. Davis, 214 Birch, Tooele, Utah 84074

[21] Appl. No.: 708,916

[22] Filed: Jul. 26, 1976

[51] Int. Cl.[2] ..... A63F 7/06

[52] U.S. Cl. ..... 273/85 E; 273/110

[58] Field of Search ..... 273/85 C, 85 E, 110

[56] References Cited

U.S. PATENT DOCUMENTS

| | | | |
|---|---|---|---|
| 1,319,372 | 10/1919 | Biertuempfel | 273/85 E |

FOREIGN PATENT DOCUMENTS

| | | | |
|---|---|---|---|
| 28,595 | 1918 | Norway | 273/85 E |
| 4,932 | 3/1909 | United Kingdom | 273/85 E |
| 864,998 | 4/1961 | United Kingdom | 273/85 E |

*Primary Examiner*—Paul E. Shapiro

*Attorney, Agent, or Firm*—Trask & Britt

[57] ABSTRACT

A game table is constructed with a table top comprised of a plurality of side-by-side transverse (lever) members, each of which pivots at its center across a longitudinal table support (fulcrum) member. Players are positioned along opposite sides of the table and guide a scoring object along the table top by pivoting the transverse members assigned to them.

21 Claims, 5 Drawing Figures

12
18
52
30
20
26
26b
20
10
24
50
22
16
14
28
26
26a
49
20
49

50
24
30
20a
26b
52
54
4
20
26a
4
52
20
18
24a
60
60
62
24b
62
56
10
3
52
3
52
26
53
18
16
28
20b 24
48
40
24
26
46
47
36
34
16
32
38
41
42
44

24
40
20
48
46
24
34
26a
16
36
38
32
47
44
41
42

44
42
16
30
20
26
20
20
26
28
38
16
20

TABLE GAME

BACKGROUND OF THE INVENTION

1. Field

This invention relates to games. More particularly, it relates to games having a table playing surface and a movable scoring object in which the skill of game players is employed to move the scoring object about the playing surface.

2. State of the Art

A variety of skill games have been devised and are well know. In particular, in recent years a table soccer game ("foose ball") has achieved some popularity. Table games such as foose ball, air hockey, and the like, may be characterized as competitive goal scoring games that combine factors such as luck or chance with skill and experience to make the game enjoyable as well as competitive and challenging. Games similar in character are desirable.

It may be noted that for some, games like foose ball are difficult to play because they may require the development of a high degree of skill for successful, competitive or enjoyable participation. Accordingly, there is a need for other such games that are less complex or easier to learn, but of the same character.

SUMMARY OF THE INVENTION

The table game of the instant invention is comprised of a movable scoring object and a game table. The game table is comprised of support means, an elongated fulcrum member, a table top comprised of a plurality of side-by-side transverse lever members, mounting means to pivotally mount each of the lever members to the fulcrum member, first bumper means mounted to the table top, handle means adapted to each of the lever members, and first and second goal means. The support means supports the game table and has the elongated fulcrum member adapted thereto. The lever members are pivotally mounted to the fulcrum member proximate each other and each pivotable about the fulcrum member in a plane substantially normal thereto in clockwise and counterclockwise directions through a preselected arc. The first bumper means is secured to the lever members in accordance with a preselected pattern to form a game playing area on the table top and to contain the movable scoring object. The first and second goal means are positioned with respect to the table top in accordance with a preselected pattern and sized to receive the movable scoring object. In operation, players are positioned along opposite sides of the table top and pivot lever members assigned to them to move the movable scoring object about the table top area with the objective of having the movable scoring object enter the first or second goal means which are assigned to different players in accordance with game rules.

The game table may also include second bumper means secured to each of the lever members in accordance with a preselected pattern within the game playing area to interact with the movable scoring object. The side-by-side transverse lever members are preferably positioned closely adjacent each other and shaped so that the table top is a substantially rectilinear projection with the first bumper means positioned along the outside edges of the table top in accordance with the preselected pattern. The preselected arc is selected so that when a first lever arm is pivoted to its maximum clockwise direction and a second adjacent lever arm is pivoted to its maximum counterclockwise direction, the movable scoring object cannot pass through the table top at any point along the adjacent edges of the pivoted first and second lever members.

In another embodiment, the mounting means preferably includes reslient means to cause the lever members to return to an at rest position in the plane of the table top after movement therefrom. The mounting means may also include a pin member centrally secured to each of the lever members to extend through a corresponding aperture formed in the fulcrum member. Preferably the fulcrum member has a flat surface in a plane substantially parallel to the plane of the table top. The flat surface extends along the length of the fulcrum member and has the apertures formed therein. The resilient means may be comprised of a spring positioned about the pin member between the flat surface and the distal end of the pin member to compress upon pivoting the lever member in either the clockwise or counterclockwise direction about the outside edges of the flat surface of the fulcrum member.

In a highly preferred embodiment, the table top has substantially parallel opposite longitudinal outside edges and is comprised of an even integer number of side-by-side transverse lever members positioned closely proximate each other with the handle means fixed to each of the lever arms to extend away from the longitudinal outside edges in a pattern in which the handle means of any two adjacent lever members extend away from opposite longitudinal outside edges of the table top. The table top may be regarded as having two opposite halves each comprised of half of the lever members wherein the first bumper means is comprised of resilient means for contact with the scoring object positioned about the edges of the table top in accordance with a preselected pattern in which the bumper means are positioned symmetrically with respect to the table top halves. The second bumper means may be comprised of a plurality of posts having resilient means adapted thereto for contact with the scoring object. The posts are secured to the table top in accordance with a preselected pattern which is symmetrical with respect to the table top halves. The movable scoring object may preferably be a metal ball; and the first and second goal means may preferably be apertures sized to receive the ball. The first and second goal means are preferably symmetrically positioned in the outermost lever members of the table top.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
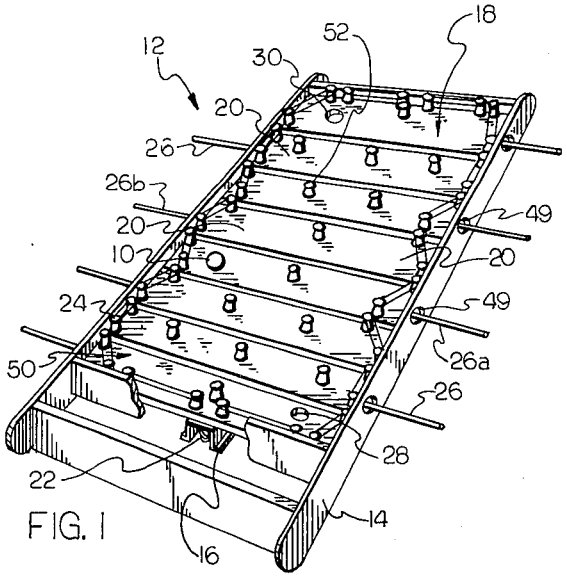
FIG. 1 is perspective view of a table game of the invention.

FIG. 1 depicts a table game of the instant invention which is comprised of a movable scoring object 10 and a game table generally indicated by the number 12. The game table is comprised of support means 14 to support the game table 12, an elongated fulcrum member 16, a table top 18 comprised of a plurality of lever members 20, mounting means 22, first bumper means 24, handles 26, first goal means 28, and second goal means 30.

The support means 14 as here illustrated, is a structure which supports the game table 12. It is comprised of any desired supporting structure including legs or feet for positioning the game table 12 at preferably waist (convenient playing) height above a floor or for positioning the game table 12 on another table or similar structure.

Figure 3:
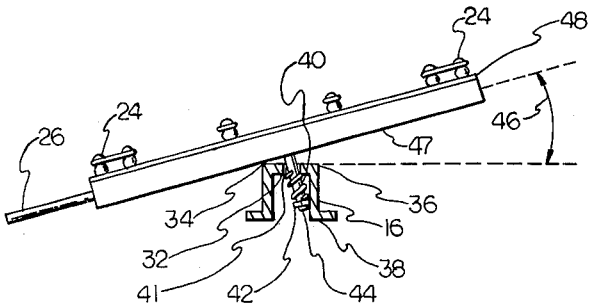
FIG. 3 is a sectional side view of the table top of FIG. 2 along the section lines 3-3 with a lever member rotated in a counterclockwise direction.
Figure 4:
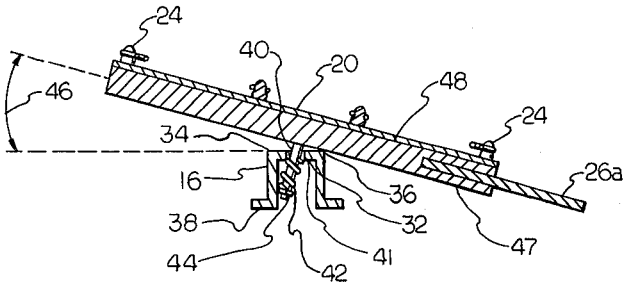
FIG. 4 is a sectional side view of a lever member of the table game of FIG. 2 along the section lines 4-4 with a lever member rotated in the clockwise direction.
Figure 5:
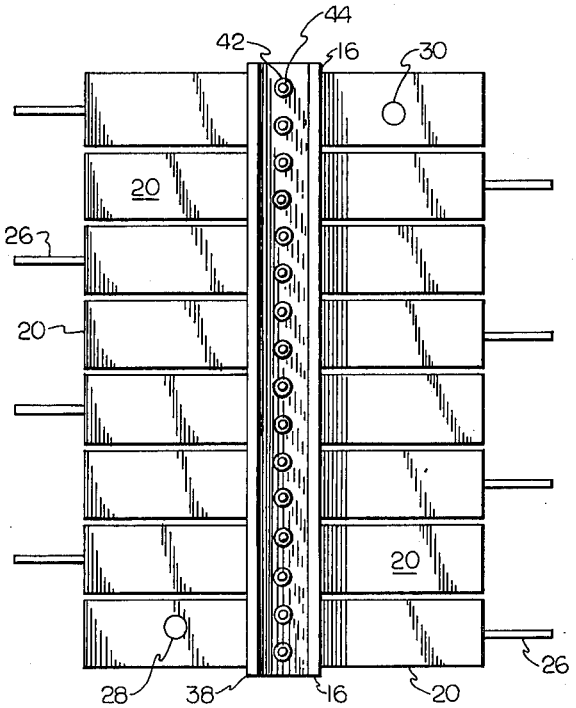
FIG. 5 is a bottom view of the table game of the invention.

The elongated fulcrum member 16, which is best illustrated in FIGS. 3, 4 and 5, is adapted to the support means 14. The fulcrum member 116 as here illustrated, is an elongated beam which is 'U'-shaped in section. It has a substantially flat top surface 32 which has two substantially parallel longitudinal side edges 34 and 36. It also has flanges 38 along its length to provide structural stability and to provide structure for adapting the fulcrum member 16 to support means 14.

The mounting means 22 is best depicted in FIGS. 3 and 4. It is comprised of a pin member 40 centrally adapted to each of the lever members 20 to extend through corresponding apertures 41 formed in the flat surface 32 of the fulcrum member 16. The mounting means preferably includes resilient means to cause the lever member 20 to return to an at rest position (substantially in the plane of the table top as illlustrated in FIG. 1) from a pivoted position as illustrated in FIGS. 3 and 4. The resilient means in this embodiment, is a spring 42 mounted proximate the distal end 44 of the pin 40 to coact with the flat surface 32 of the fulcrum member 16 and a nut 45 (or ring) so that when the lever members 20 ar pivoted as illustrated in FIGS. 3 and 4, the spring 42 will be compressed to force the lever members 20 to the at rest position illustrated in FIG. 1. That is, when the lever members 20 are rotated by the players who exert a pivoting force on the handle means 26, the spring 42 is compressed so that upon release of the force from the handle 26, the spring 42 will tend to decompress and cause the lever member 20 to rotate back to its at rest position illustrated in FIG. 1. It should be recognized that other mounting means employing other resilient means may be used. For example, the lever members may be hingedly secured to the flat surface 32 of the fulcrum member 16; and the resilient means may be comprised of springs associated with the hinge. However, it is preferred to use the spring 42 as illustrated.

The table top 18, as hereinbefore indicated, is comprised of a plurality of lever members 20 mounted along and normally to the fulcrum member 16. That is, the lever members 20 are transversely mounted to the fulcrum member 16 side-by-side and are pivotable about the fulcrum member 16 in a plane substantially normal thereto. The lever members 20 are pivotable in clockwise and counterclockwise directions in a preselected arc 46 as best illustrated in FIGS. 3 and 4. The arc 46 is selected so that upon the pivoting of one of two adjacent lever members 20, one to its maximum clockwise direction and the other to its maximum counterclockwise direction, the movable scoring object 10 will not pass through the table top 18 at any point along the edges of the adjacent lever members 20. The lever members 20 may be fabricated from any appropriate structurally rigid material such as pressed wood, plywood or the like. Preferably, a hard material 48 (e.g., formica) is adapted to the rigid material 47 to provide a smooth surface which is durable and will not wear rapidly. It may also be noted that in the embodiment of FIG. 1, the handles 26 extend through the support means 14 which has elongated apertures 49 formed therein for each handle 26 to extend through and sized to permit movement of the lever member 20 through the preselected arc 46.

As illustrated, the table top 18 is preferably rectilinear in section with the first bumpers 24 positioned along the outside edges thereof in a preselected pattern to form a playing area, generally indicated by the numeral 50, and to retain the movable scoring object 10 therewithin. It may be noted that other geometric shapes for the table top 18 may be selected; however, it is preferably rectilinear in shape. The table top 18 may also include second bumper means 52 adapted to each of the lever members 20. The second bumpers 52 are positioned within the playing area 50 in accordance with a preselected pattern. The second bumpers 52 are comprised of posts secured to the lever members 20 with resilient means (e.g., a rubber-like strip) adapted thereto to interact with the movable scoring object 10.

Figure 2:
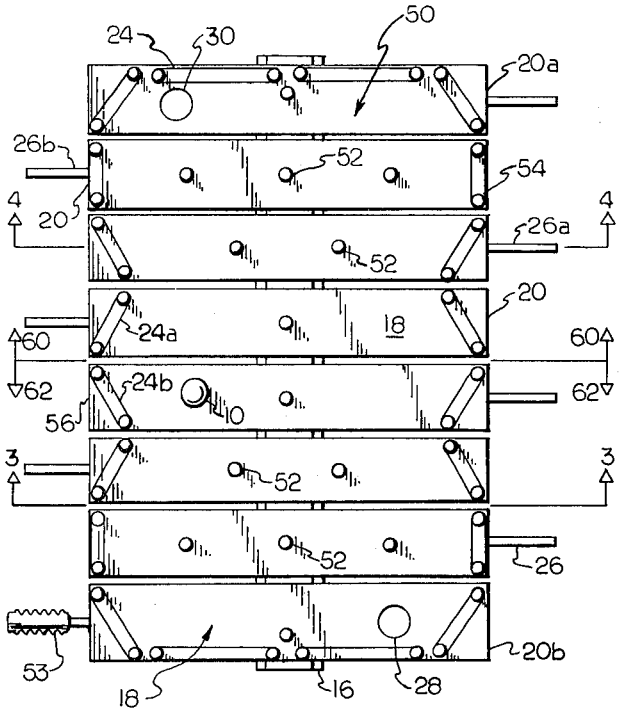
FIG. 2 is a top view of a table game of the invention.

As best seen in FIGS. 1, 2 and 5, the handles 26 are adapted directly to each of the lever members 20. The handles 26 are preferably cylindrical devices with optional grips 53 adapted thereto. The handles 26 are preferably frictionally installed in apertures formed in the bases 47 of the lever members 20. The handles 26 are for use by the players to rotate the lever members 20 through the preselected arc 46. The handles 26 are secured to extend away from the longitudinal edges 54 and 56 of the table top 18 in a preselected pattern wherein the handles 26a, 26b of any two adjacent lever members 20 extend away from opposite longitudinal edges 54, 56, respectively. For the table top 18 illustrated, eight lever members 20 are provided; and the handles 26 are positioned so that four handles 26 extend away from each of the longitudinal edges 54 and 56. Accordingly, each side or team playing the game has an equal number of handles 26 and in turn lever members 20 within their control pursuant to the envisioned rules for playing the table game of the instant invention.

As can best be seen in FIGS. 1 and 2, the preseclected pattern for the first bumpers 24 is symmetric. That is, the table top may be regarded as having two opposite halves as indicated by the section line arrows 60 and 62. Each of the halves 60 and 62 are comprised of an equal number of adjacent lever members 20. The bumper means 24 are positioned to be symmetric with respect to the halves 60 and 62. That is, the pattern for the first bumpers 24 in the first half 60 may be regarded as the mirror image (symmetric) of the pattern of the first bumpers in the second half 62. It should also be noted that the second bumpers 52 are similarly symmetrically positioned within the playing area of the respective first and second halves 60, 62 of the table top 18.

The first and second goals 28 and 30, as best illustrated in FIG. 2, are apertures formed in the outermost lever members 20*a*, 20*b*. the apertures ae sized to receive the movable scoring object 10 which is preferably a spherically shaped metal ball. Other goal means including slots in structure adjacent the outermost lever members 20*a*, 20*b* may also be used.

To play the game as presently envisioned, the ball 10 is centrally deposited in the playing area 50. Players positioned along the opposite longitudinal sides 54, 56 of the table top 18 thereupon commence pivoting the side-by-side lever members 20 to cause or urge the ball 10 to move about the playing area 50 and interact with the first and second bumpers 24 and 52 so that the ball 10 will move toward and into one of the goals 28, 30 which are assigned to players and/or teams by game rules. For example, the player(s) positioned along longitudinal side 54 would be assigned the goal formed in lever member 20*a* and would manipulate those lever members 20 having handle means 26 extending away from the longitudinal side 54 to cause the ball 10 to pass through the goal 30. Simultaneously, the player(s) positioned along the other longitudinal side 56 would manipulate the lever members 20 extending away from their longitudinal side 56 to prevent the ball 10 from entering goal 30 and to cause the ball 10 to move toward and pass into their goal 28 in lever member 20*b*.

In order to best effect game operation as hereinabove described, it is preferred that the table top be positioned in a horizontal plane so that gravitational forces will not affect the ball 10 and cause it to move preferentially in one direction or another to a player's disadvantage or advantage. It is also contemplated that the game may be played by more than two players. That is, the game may be played by teams, the members of which are assigned to operate the various lever members extending away from their resective longitudinal sides 54, 56. It should also be recognized that although the table top 18 herein illustrated is comprised of eight side-by-side lever members 20, the table top 18 may be comprised of a plurality of lever members 20, preferably an even integer in number. It may further be noted that the preselected pattern for the bumper means 24 is such that selected portions thereof, 24*a* and 24*b* for example, are angularly disposed with respect to the longitudinal edges 54 and 56 so that as the ball 10 moves toward or away from the longitudinal side edges 54 and 56 it may interact with the angularly positioned bumper 24*a*, 24*b* to cause the ball to move in an axial direction, viz: in a direction toward or away from the first and second goals 28 and 30.

The table top 18 as illustrated is sized to be about three feet long and about two feet wide. It should be recognized however, that the table top 18 as herein described may be of any convenient dimensions. It may even be miniaturized to a "pocket" size.

It is be understood that the embodiments of the invention herein described are merely illustrative of the application of the principles of the invention. Reference herein to details of the illustrated embodiments is not intended to limit the scope of the claims which themselves recite those features regarded as essential to the invention.

I claim:

1. A table game comprised of a movable scoring object and a game table, said game table comprising: support means to support said game table;

an elongated fulcrum member mounted to said support means;

a flat table top comprised of a plurality of side-by-side lever members which extend between opposite outside edges of said table top and which are centrally and transversely mounted to said fulcrum member, each lever member being pivotable about said fulcrum in a plane substantially normal thereto in clockwise and counterclockwise directions through a preselected arc;

mounting means to pivotably mount each said lever member to said fulcrum member;

a plurality of first bumper means each secured to a lever member along the outside edges of said lever members to form a game playing area on said table top and to contain said movable scoring object on said table top;

a handle secured to each of said lever members to extend away from an outside edge of said table top for use by game players; and first and second goal means positioned proximate opposite outside edged of said table top and sized to receive said movable scoring object.

2. The table game of claim 1 further comprising a plurality of second bumper means each secured to selected lever members in accordance with a preselected pattern with respect to said table top and within said game playing area to interact with said movable scoring object.

3. The table game of claim 2 wherein said lever members are shaped so that said table top is substantially rectalinear in projection.

4. The table game of claim 3 wherein said preselected arc is selected so that when a first lever member is pivoted to its maximum clockwise direction and a second lever arm next adjacent to said first lever member is pivoted to its maximum counterclockwise direction, said movable scoring object cannot pass through said table top at any point along the adjacent edges of said first and second lever members.

5. The table game of claim 4 wherein said mounting means includes resilient means to cause said lever members to return to the plane of said table top after movement therefrom.

6. The table game of claim 5 wherein said elongated fulcrum member has a substantially flat top surface extending along its length which has substantially parallel outside edges, and wherein said mounting means includes a pin member centrally secured to each of said lever members which extends through a corresponding aperture formed in said flat top surface, and wherein said resilient means is comprised of a spring positioned about said pin member between said flat surface and the distal end of said pin member to compress upon pivoting said lever member about the outside edges of said flat surface of said fulcrum member and to force the lever member back to the plane of said table top after movement therefrom.

7. The table game of claim 6 wherein said table top is comprised of an even integer number of said side-by-side lever members with said handles fixed to each in a pattern in which the handles of any two adjacent lever members extend away from said table top in opposite directions.

8. The table game of claim 7 wherein said table top has two opposite halves each comprised of a plurality of adjacent side-by-side lever members, wherein said first bumper means includes resilient means for contact with said scoring object positioned symmetrically along opposite edges of said table top and symmetrically with respect to each of said table top halves, and wherein said second bumper means is comprised of a plurality of posts having resilient means adapted thereto for contact with said scoring object, said posts being secured to said table top in accordance with a preselected pattern which is symmetrical for each of said table top halves.

9. The table game of claim 8 wherein said movable scoring object is a metal ball and said first and second goal means are apertures formed in the outermost lever members and sized to receive said ball, said apertures being symmetrically positioned with respect to said table top which is substantially flat and horizontally positioned.

10. For a table game of the type having a movable scoring object and a flat table top playing surface with first and second goal means in which opposing players urge the movable scoring object to assigned goals by means, the improvement wherein said flat playing surface is comprised of a plurality of side-by-side lever members which extend between opposite outside edges of said table top and which are centrally, transversely and pivotally mounted by mounting means to an elongated fulcrum member to pivot thereabout in clockwise and counterclockwise directions through a preselected arc with a handle affixed to each of said lever members to extend away from an ouside edge of said table top and with a plurality of first bumper means secured to each lever member along the outside edge of said playing surface to form a game playing area and to contain said scoring object.

11. The improvement of claim 10 further comprising a plurality of second bumper means each secured to selected lever members in accordance with a preselected pattern with respect to said table top and within the area defined by the first bumper means.

12. The improvement of claim 11 wherein said lever members are shaped so that the playing surface is substantially rectilinear in projection with said first and second bumper means being positioned symmetrically with respect to the edges thereof and with respect to opposite halves thereof.

13. The improvement of claim 12 wherein said preselected arc is selected so that when a first lever member is pivoted to its maximum clockwise direction and a second lever arm next adjacent to said first lever member is pivoted to its maximum counterclockwise direction, said movable scoring object cannot pass through said playing surface at any point along the adjacent edges of said first and second lever member.

14. The imrovement of claim 13 wherein said elongated fulcrum member has a substantially flat top surface extending along its length which has substantially parallel outside edges, wherein said mounting means includes resilient means and a pin member, said pin member being centrally secured to each of said lever members which extends through a corresponding aperture formed in said flat top surface, and said resilient means being comprised of a spring positioned about said pin member between said flat top surface and the distal end of said pin member to compress upon pivoting said lever member about the outside edges of said flat top surface of said fulcrum member and to force the lever member back to the plane of said table top after movement therefrom.

15. The improvement of claim 14 wherein said table top is comprised of an even integer number of said side-by-side lever members with said handles fixed to each in a pattern in which the handles of any two adjacent lever members extend away from said table top in opposite directions, wherein said first bumper means includes resilient means symmetrically positioned about the opposite edges of said playing surface, wherein said second bumper means is comprised of a plurality of posts having resilient means adapted thereto for contact with said scoring object, said posts being secured to said table top in accordance with a preselected pattern which is symmetrical for each of said table top halves, and wherein said movable scoring object is a metal ball and said first and second goal means are apertures formed in the outermost lever members and sized to receive said ball, said apertures being symmetrically positioned with respect to said table top which is substantially flat and horizontally positioned.

16. A table game comprised of a movable scoring object and a game table, said game table comprising:

support means to support said game table;

an elongated fulcrum member mounted to said support means, said fulcrum member having a substantially flat top surface extending along its length which has substantially parallel outside edges;

a table top comprised of a plurality of side-by-side lever members transversely mounted to said fulcrum member each pivotable thereabout in a plane substantially normal thereto in clockwise and counterclockwise directions through a preselected arc;

mounting means to pivotably mount each said lever member to said fulcrum member, said mounting means including resilient means to cause said lever members to return to the plane of said table top after movement therefrom and a pin member centrally secured to each of said lever members which extends through a corresponding aperture formed in said flat top surface, said resilient means being comprised of a spring positioned about said pin member between said flat surface and the distal end of said pin member to compress upon pivoting said lever member about the outside edges of said flat surface of said fulcrum member and to force the lever member back to the plane of said table top after movement therefrom;

a plurality of first bumper means each secured to a lever member along the outside edges of said table top to form a game playing area on said table top and to contain said movable scoring object on said table top;

a handle secured to each of said lever members to extend away from an outside edge of said table top for use by game players;

first and second goal means positioned with respect to said table top proximate opposite outside edges thereof and sized to receive said movable scoring object;

a plurality of second bumper means each secured to selected lever members in accordance with a preselected pattern with respect to said table top and within said game playing area to interact with said movable scoring object.

17. The table game of claim 16 wherein said table top is comprised of an even integer number of said side-by-side lever members with said handles fixed to each in a pattern in which the handles of any two adjacent lever members extend away from said table top in opposite directions.

18. The table game of claim 17 wherein said table top has two opposite halves each comprised of a plurality of adjacent side-by-side lever members, wherein said first bumper means includes resilient means for contact with said scoring object positioned symmetrically along opposite edges of said table top and symmetrically with respect to each of said table top halves, and wherein said second bumper means is comprised of a plurality of posts having resilient means adapted thereto for contact with said scoring object, said posts being secured to said table top symmetrically with respect to said table top halves.

19. The table game of claim 18 wherein said movable scoring object is a metal ball and said first and second goal means are apertures formed in the outermost lever members and sized to receive said ball, said apertures being symmetrically positioned with respect to said table top which is substantially flat, rectalinear in projection and horizontally positioned.

20. For a table game of the type having a movable scoring object and a flat table top playing surface with first and second goal means in which opposing players urge the movable scoring object to assigned goals by means, the improvement wherein said flat playing surface is comprised of a plurality of side-by-side lever members pivotally mounted by mounting means to an elongated fulcrum member to pivot thereabout in clockwise and counterclockwise directions through a preselected arc with a handle affixed to each of said lever members to extend away from an outside edge of said table top, with a plurality of first bumper means secured to each lever member along the outside edge of said playing surface to form a game playing area and to contain said scoring object, with a plurality of second bumper means each secured to selected lever members in accordance with a preselected pattern with respect to said game playing area and therewithin, and wherein said elongated fulcrum member has a substantially flat top surface extending along its length which has substantially parallel outside edges, wherein said mounting means includes resilient means and a pin member, said pin member being centrally secured to each of said lever members to extend through a corresponding aperture formed in said flat top surface, and said resilient means being comprised of a spring positioned about said pin member between said flat top surface and the distal end of said pin member to comress upon pivoting said lever member about the outside edges of said flat top surface of said fulcrum member and to force the lever member back to the plane of said table top after movement therefrom.

21. The improvement of claim 20 wherein said table top is comprised of an even integer number of said side-by-side lever members with said handles fixed to each in a pattern in which the handles of any two adjacent lever members extend away from said table top in opposite directions, wherein said first bumper means includes resilient means symmetrically positioned about the opposite edges of said playing surface, wherein said second bumper means is comprised of a plurality of posts having resilient means adapted thereto for contact with said scoring object, said posts being secured to said table top in accordance with a preselected pattern which is symmetrical for each of said table top halves, and wherein said movable scoring object is a metal ball and said first and second goal means are apertures formed in the outermost lever members and sized to receive said ball, said apertures being symmetrically positioned with respect to said table top which is substantially flat, rectalinear in projection and horizontally positioned.

* * * * *